United States Patent [19]

Taylor

[11] Patent Number: 4,471,989

[45] Date of Patent: Sep. 18, 1984

[54] TELESCOPIC CONTAINER SPREADER

[76] Inventor: Richard J. Taylor, S-162 40, Vällingby, Sweden

[21] Appl. No.: 324,386

[22] PCT Filed: Apr. 13, 1981

[86] PCT No.: PCT/SE81/00115

§ 371 Date: Nov. 12, 1981

§ 102(e) Date: Nov. 12, 1981

[87] PCT Pub. No.: WO81/03013

PCT Pub. Date: Oct. 29, 1981

[30] Foreign Application Priority Data

Apr. 15, 1980 [SE] Sweden ..... 8002354

[51] Int. Cl.[3] ..... B66C 1/66

[52] U.S. Cl. ..... 294/81 SF

[58] Field of Search ..... 294/81 SF, 67 R, 67 DA, 294/67 D, 81 R, 88, 110; 414/620, 621, 730

[56] References Cited

U.S. PATENT DOCUMENTS 3,767,250 10/1973 Ward ..... 294/81 SF
4,017,110 4/1977 Pease et al. ..... 294/81 SF

FOREIGN PATENT DOCUMENTS 493707 7/1977 Australia ..... 294/81 SF
311067 5/1969 Sweden .

*Primary Examiner*—James B. Marbert
*Attorney, Agent, or Firm*—Fleit, Jacobson, Cohn & Price

[57] ABSTRACT

A telescope spreader for lifting loads of various lengths i.e. load-holders or containers, comprising a main beam (20) and within its longitude at least two opposingly movable telescope beams (21 and 22). These have at their outer ends means (23) for coupling to the load to be lifted. The main beam (20) has extensions (28) at its upper gable ends which extend out almost as far as that on the same side telescope beam's (22) outer end when that telescope beam (22) is in its innermost position. Each extension (28) is designed to accept the extended inner end (27) or that in the opposite direction extensible telescope beam (21) when in its innermost portion. By the invention the forces $P_1$, $P_2$ working upon the main beam are reduced thus rendering the beam a lighter weight.

6 Claims, 2 Drawing Figures

TELESCOPIC CONTAINER SPREADER

The present invention relates to a construction for telescopic container spreaders. Such spreaders have become necessary because although containers normally have uniform width dimensions, they have differing standard lengths. In order to be able to handle these differing containers with the same spreader, it must be made telescopic.

Such spreaders contain a fixed main beam which usually supports two movable telescope beams arranged within the main beam. In the telescopic beam's outer ends are mounted container locking devices, generally referred to as twist-locks, which during lifting combine with the container's upper corner castings. When the telescope beams are moved outwards to their extreme position, their underside makes direct contact with the outer lower edge of the main beam whilst the upper inner ends of the telescope beams makes direct contact with the upper inside of the main beam. During the lifting of a container both these contact points transfer the forces from the telescope beams to the main beam. The extent of the forces at the stated points is determined partly by the weight lifted at the telescope beams outer ends via the twistlocks and partly by the leverage relationship determined by the distance between the twistlocks, the main beam's lower outer edge, and the telescope beam's inner upper edge. Particularly, the effect on the main beam's lower, outer edge will be very big, which leads to cumbersome and heavy constructions.

The purpose of the invention is to reduce the effect of the stated forces, particularly the very heavy force at the main beam's lower outer edge, so that the spreader can be made lighter in construction. The purpose of the invention is achieved because the main beam's upper gable ends have, above in the direction of the telescope beams movement, parts which extend the outer portion of and on the same side as the telescope beam's outer, end in the contracted position. The extended part increases the length of the upper part of the main beam. The end part extensions accommodate the extended inner end of the telescope beam which moves in the opposite direction. By means of this simple solution, the distance between the force transfer points of the telescope beams and the main beams is increased so much that a considerable reduction of the force's effect is achieved.

The invention is more fully described with reference to the attached drawings.

Figure 1:
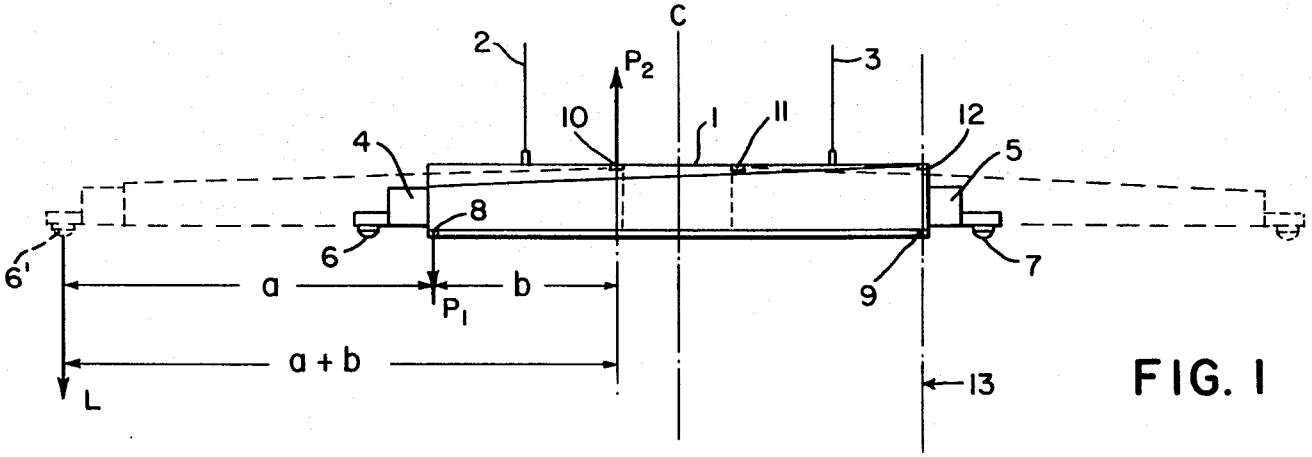

In FIG. 1 is shown a conventional spreader with both telescope beams in their innermost position and by means of broken lines with both telescope beams in their outermost position.

Figure 2:
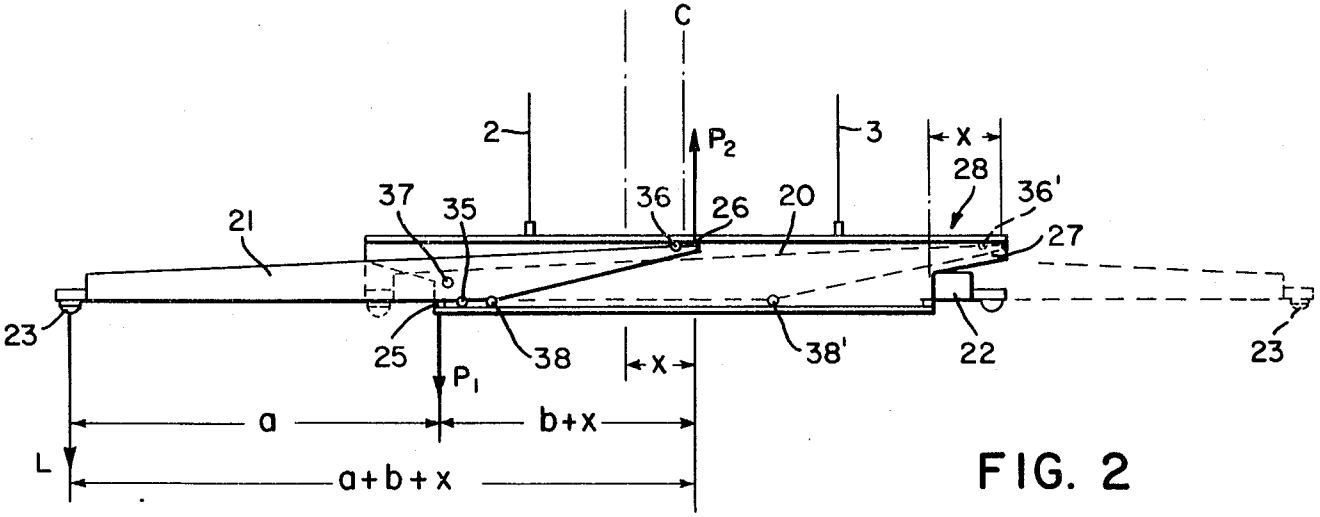

FIG. 2 shows a spreader in accordance with the invention with the left telescope beam in its outermost position.

In FIG. 1 marked with 1 is the main beam, which through suitable coupling means 2, 3 is united with the lifting equipment which supports the spreader, i.e. a gantry crane, a traverse, a fork-truck or similar equipment. The main beam supports two movable telescope beams 4, 5, which can be extended from an innermost position to varying outer positions determined by the length of the container to be lifted. Usually, this length is variable between 20 ft. and 40 ft. In the telescope beams outer ends are mounted twistlocks 6, 7 arranged to combine with the upper corner castings of the container during lifting. These twistlocks are mounted on a crossbeam at each telescope beam's 4, 5 outer end.

A telescope spreader is usually manufactured to be symetric so that the telescope beams extend from the main beam uniformly, thereby ensuring that the spreader's central axis C and its gravity point will be unchanged, unaffected by the extension of the telescope beams. FIG. 1 shows with broken lines the spreader in its maximum extended position. When the telescope beams 4 is in its outermost position with the twistlock in position 6' the telescope beam's underside rests against a contact part 8 on the main beam's lower, outer edge. The telescope beam's 4 inner upper edge has a contact part 10 which rests against the main beam's inner roof which has a contact part complementary to contact part 10. In a similar way occurs the support of the right telescope arm 5, when it is in its outermost position, at points 9 and 11 when correspond to points 8 and 10. The telescope beam's movement can be effected with the assistance of hydraulic cylinders, electric winches or similar equipment.

In FIG. 2 the spreader is shown according to the invention. The figure shows only the main beam 20 and the left telescope beam 21. As the complete spreader is symetric, only the relationship regarding the spreader and the left telescope beam is described in the following. For the right telescope beam 22 is the relationship identical.

In FIG. 1 when the lifting telescope beam 4 is extended to its outermost position, the distance between the twistlock 6' which supports the container load L and the main beam's lower outer edge 8 is marked with the letter a. The distance from edge 8 to telescope beam's 4 inner upper edge 10 has been marked b. At points 8 and 10 the main beam 1 is subjected to forces $P_1$ and $P_2$.

From this figure is obtained the extent of the forces $P_1$ and $P_2$ as follows:

$$P_1 = L(a+b)/b = L(a/b+1)$$

$$P_2 = L(a/b)$$

From this it is obvious that both the forces $O_1$ and $P_2$ vary proportionally opposite to the length b. This means therefore that the forces will be reduced relative to any increase in the distance b.

With previously known spreaders the main beam 1 has been made with straight limiting gables as is shown at 12 on the right-hand side of FIG. 1. This means that the outer part of telescope beam 5 with twistlock 7 extends beyond the gable end plane 13.

In order to increase the distance b the invention makes use of the possibility to increase the spreader's length with length x which extends above almost as telescope beam 22 (see FIG. 2) by shaping the main beam 20 with an upper extension 28. This means that the complete spreader's length will be unchanged whilst the rear part 27 of telescope beam 21, which is movable in the opposite direction, can be increased by the length x thereby also increasing by x the distance between telescope beam's 21 upper contact point 26 and the main beam's contact point 25. Hereby is increased the distance between contact points 25 and 26 from b to (b+x), whilst the distance between twistlock 23 and contact point 25 remains unchanged.

As shown by FIG. 2 the invention discloses a substantial increase of distance between contact points from b to (b+x) thereby causing a considerable decrease in the forces $P_1$ and $P_2$ to which the main beam 1 is subjected through the container load L. This makes possible the lighter construction and the economic benefits which are named above.

Nearby the above named contact points 25 and 26 are arranged rollers 35, 36 which, being swingable and spring-loaded, extend beyond the respective contact points'surface when the telescope beam 21 is without load but which are impressed when the telescope beam's outer end 23 is loaded with the containers weight L during lifting. Hereby is achieved direct contact between the main beam and the telescope beam at points depending upon the containers differing lengths. When the telescope beam 21 is fully telescoped in, the upper roller 36' is in a position of very near proximity to the main beam's gable end 13. Because of the stated rollers, there will be very little friction when the telescope beam 21 is moved within the main beam 20. When the telescope beam's 21 gravity centre 37 arrives in inside front of roller 35, the beam will cant clock-wise to make direct contact with the main beam. To facilitate movement of the telescope beam 21 before this position, there is arranged on each telescope beam's lower, against mair beam's 20 facing side, a roller 38 for supporting part of the telescope beam's weight during movement between the points 38 and 38' marked on FIG. 2.

When telescope beam's 21 upper roller 36 is in position 36' it is easily accessible for servicing purposes, using openings at the outer side of the end portion 28. For the same reason openings may be arranged at the rollers 35 and 38 at the lower part of main beam 20.

The aims of the invention can be achieved through various designs within the framework of the following patent claims.

I claim:

1. A telescopic spreader for lifting loads of various lengths said spreader comprising an elongated main beam with upper and lower edges, said main beam being provided with extensions on said upper edges of each end of said upper edge and at least two symmetrical telescoping beams which are slidably mounted within said main beam, the ends of said telescoping beams being shaped at an angle which allows said ends of said telescoping beams to be received within said extensions on said main beam when said telescoping beams are in a retracted position.

2. A telescopic spreader according to claim 1 which further comprises contact points for transmitting the stress forces from the load to said main beam, said contact points being located at the outer and lower edges of said main beam and at the inner upper part of each of said telescoping beams.

3. A telescopic spreader according to claim 2 which further comprises spring-loaded rollers which act as contact points between said main beam and said telescopic beams when said spreader is in the unloaded position, said rollers being located in close proximity to said contact points so that said rollers are depressed to allow said contact points to make direct contact with each other when said spreader is in the loaded position.

4. A telescopic spreader according to claim 3 which further comprises spring-loaded rollers attached to each telescoping beam on the lower edge of the side of said telescoping beam which faces said main beam, said roller being located between the centers of gravity of said telescoping beams and the rear contact point of said telescoping beams.

5. A telescopic spreader according to claim 1 wherein said extensions on said main beam extend to substantially the length of the outer ends of said telescoping beams when said telescoping beams are in their retracted positions.

6. A telescopic spreader according to claim 4 wherein said main beam is further provided with openings at the upper and lower edges of said extensions for allowing access to said rollers, for servicing said rollers.

* * * * *